US009357844B2

(12) United States Patent
O'Hara

(10) Patent No.: US 9,357,844 B2
(45) Date of Patent: Jun. 7, 2016

(54) HANGING CORNER SHELF ASSEMBLY

(75) Inventor: Barbara O'Hara, Orlando, FL (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 0 days.

(21) Appl. No.: 13/411,013

(22) Filed: Mar. 2, 2012

(65) Prior Publication Data

US 2013/0228541 A1 Sep. 5, 2013

(51) Int. Cl.

| | |
|---|---|
| ***A47F 5/08*** | (2006.01) |
| ***A47B 96/02*** | (2006.01) |
| ***A47B 96/16*** | (2006.01) |
| ***A47G 25/06*** | (2006.01) |
| *A47F 5/00* | (2006.01) |
| *A47B 43/00* | (2006.01) |
| *A47B 61/00* | (2006.01) |

(52) U.S. Cl.

CPC ..... *A47B 96/022* (2013.01); *A47B 96/16* (2013.01); *A47G 25/06* (2013.01); *A47B 43/00* (2013.01); *A47B 61/00* (2013.01); *A47F 5/08* (2013.01); *A47F 2005/0012* (2013.01)

(58) Field of Classification Search

CPC .. A47B 47/027; A47B 96/022; A47B 97/001; A47B 43/00; A47B 61/00; A47B 96/16; A47F 5/0068; A47F 3/002; A47F 5/0006; A47F 5/0018; A47F 5/08; A47F 2005/0012; A47G 25/0685; A47G 25/06; A47G 25/0621; A47G 25/743; A47G 25/18; A47G 25/0614; A47G 29/02

USPC ..... 211/113, 119.003, 119.009, 86.01, 211/87.01, 90.01, 90.04, 134, 85.3, 118, 211/117; 248/213.1, 220.1, 205.1; 108/42, 108/152, 47; 312/321.5

See application file for complete search history.

(56) References Cited

U.S. PATENT DOCUMENTS

| | | | | | |
|---|---|---|---|---|---|
| 116,862 | A | * | 7/1871 | Peirce | 108/152 |
| 939,005 | A | * | 11/1909 | Goedeke | 217/69 |
| 975,619 | A | * | 11/1910 | Hollander | 108/42 |
| 1,159,813 | A | * | 11/1915 | Volkhardt | 211/104 |
| 1,286,588 | A | * | 12/1918 | Goodykoontz | 108/28 |
| 1,325,143 | A | * | 12/1919 | Conterio | 108/42 |
| 1,455,569 | A | * | 5/1923 | Caminoni, Jr. | 108/41 |
| 1,654,409 | A | * | 12/1927 | Browne | 108/29 |
| 1,757,398 | A | * | 5/1930 | Squires | 108/42 |
| 2,036,184 | A | * | 4/1936 | Armstrong | 108/101 |
| 2,261,078 | A | * | 10/1941 | Shockey | 108/42 |
| 2,289,451 | A | * | 7/1942 | Porcelli | 108/42 |
| 2,340,545 | A | * | 2/1944 | Marsh | 217/65 |
| 2,465,635 | A | * | 3/1949 | Conterio | 108/42 |
| 2,472,004 | A | * | 5/1949 | Czerniewicz | 108/42 |

(Continued)

*Primary Examiner* — Joshua J Michener
*Assistant Examiner* — Devin Barnett
(74) *Attorney, Agent, or Firm* — Timothy H. Van Dyke; Beusse, Wolter, Sanks & Maire, PLLC

(57) ABSTRACT

A hanging corner shelf assembly is provided which includes a first member and a second member, which diverge from one another. Each member includes a first side and a second side, an inner side and an outer side. The first and second members are configured for attachment to one another. The hanging corner shelf assembly further includes at least one shelf member extending from the first member and the second member, wherein a longitudinal axis of the at least one shelf member is generally perpendicularly oriented relative to a longitudinal axis of each of the first and second members and at least one hanging member is included, wherein the at least one hanging member is engageable to the first and/or second member.

6 Claims, 4 Drawing Sheets

(56) References Cited

U.S. PATENT DOCUMENTS

| | | | | | |
|---|---|---|---|---|---|
| 2,522,442 | A | * | 9/1950 | Garris | 108/42 |
| 2,582,557 | A | * | 1/1952 | Palkman | 108/42 |
| 2,657,811 | A | * | 11/1953 | Isler | 108/42 |
| 2,665,250 | A | * | 1/1954 | Willinger et al. | 210/167.27 |
| 2,815,910 | A | * | 12/1957 | Baker | 248/220.1 |
| 3,008,585 | A | * | 11/1961 | McNeill | 108/42 |
| 3,175,696 | A | * | 3/1965 | Milbourne | 211/119.004 |
| 3,392,847 | A | * | 7/1968 | Holland et al. | 211/13.1 |
| 3,692,265 | A | * | 9/1972 | Barriger | 248/220.1 |
| 4,760,800 | A | * | 8/1988 | Hanson | 108/190 |
| D314,477 | S | * | 2/1991 | Richter | D6/479 |
| 5,040,468 | A | * | 8/1991 | Miller et al. | 108/47 |
| D328,994 | S | * | 9/1992 | Jurgens | D6/562 |
| 5,291,700 | A | * | 3/1994 | Chew | 52/36.1 |
| 5,312,078 | A | * | 5/1994 | Marsh | 248/220.1 |
| 5,349,909 | A | * | 9/1994 | Smit et al. | 108/107 |
| D388,642 | S | * | 1/1998 | Winter | D6/525 |
| 5,724,894 | A | * | 3/1998 | Knorovsky | 108/42 |
| 5,732,421 | A | * | 3/1998 | Scherberger | 4/611 |
| D409,868 | S | * | 5/1999 | France | D6/562 |
| 5,983,805 | A | * | 11/1999 | Waluda | 108/42 |
| 5,996,506 | A | * | 12/1999 | Woytovich | 108/42 |
| 6,015,123 | A | * | 1/2000 | Perez et al. | 248/220.1 |
| 6,079,336 | A | * | 6/2000 | Lindstrom | 108/42 |
| 6,196,139 | B1 | * | 3/2001 | Jensen et al. | 108/42 |
| 6,223,914 | B1 | * | 5/2001 | Snell | 211/119.04 |
| 6,267,257 | B1 | * | 7/2001 | DeBruyn | 211/119.004 |
| 6,418,590 | B1 | * | 7/2002 | Nipper et al. | 16/382 |
| 6,481,585 | B1 | * | 11/2002 | Cloughton | A47C 21/028 211/118 |
| 6,588,030 | B1 | * | 7/2003 | Wulff | 4/605 |
| 6,591,762 | B1 | * | 7/2003 | Haghayegh | 108/42 |
| 6,658,696 | B2 | * | 12/2003 | Buckelew | 16/82 |
| 6,688,238 | B1 | * | 2/2004 | Alexiou | 108/42 |
| 6,769,750 | B2 | * | 8/2004 | Hughes et al. | 312/265.5 |
| 7,226,027 | B1 | * | 6/2007 | Feeley | 248/220.1 |
| 7,621,223 | B2 | * | 11/2009 | Haghayegh | 108/42 |
| 7,938,279 | B2 | * | 5/2011 | Kaplan | 211/119.009 |
| 7,987,535 | B1 | * | 8/2011 | Tesch | 4/611 |
| 8,015,929 | B2 | * | 9/2011 | Tyner | 108/134 |
| 8,225,435 | B2 | * | 7/2012 | Kik et al. | 4/578.1 |
| 8,297,205 | B2 | * | 10/2012 | Kauffman | 108/49 |
| 2004/0140282 | A1 | * | 7/2004 | Wang | A47F 7/146 211/113 |
| 2007/0110511 | A1 | * | 5/2007 | Chen | A47B 57/40 403/230 |
| 2008/0224004 | A1 | * | 9/2008 | Gallien | 248/220.1 |
| 2010/0155350 | A1 | * | 6/2010 | Kaplan | 211/113 |
| 2011/0253861 | A1 | * | 10/2011 | Kressin | 248/224.61 |

* cited by examiner

HANGING CORNER SHELF ASSEMBLY

FIELD OF THE INVENTION

The present invention is related to an accessory for a bathroom stall in one embodiment, and, more particularly, is directed toward an easy-to-install, shelving unit.

BACKGROUND

Contemporary bathroom stalls fail to provide any convenient means by which articles can be hung or placed while the bathroom is in use. Most often, the only available article upon which to hang a purse or a brief case inside a bathroom stall is a hook on the back of the door. These hooks are not reliable, and are easily broken due to the limitations on the amount of weight they are able to withstand. Additionally, there are often multiple articles or items that one needs to unload while in the bathroom stall which cannot all be accommodated by the hooks on the back of the bathroom stall door. Furthermore, there is an interest in storing items within each bathroom stall, for example, cleaning items or even decorative items such as plants or candles. Hooks on the back of the bathroom stall door cannot be used for such storage.

Moreover, while contemporary bathroom stalls may provide handicap accessibility, particularly in reference to the sink and toilets located therein, there is often no usable space for a disabled individual to place their belongings while using the restroom. The aforementioned hook on the back of the bathroom stall door is often too high for a disabled person to reach, and furthermore, does not provide a sufficient area to rest one's belongings as discussed above.

SUMMARY

It is therefore desirable to provide a temporary and removable, as well as easily installed shelf in a bathroom stall which can be accessed by both disabled and non-disabled persons, for the placement of one's belongings while in the bathroom stall. Moreover, the embodiments described herein are not limited to use in a bathroom stall, this is only one example of use. The subject invention can be adapted for use in other areas such as shower stalls, dressing rooms, office cubicles, and any other area where two "walls" abut together forming a corner arrangement in which the subject invention can be used.

In an embodiment, a hanging corner shelf assembly is provided. The hanging corner shelf assembly includes a first member and a second member, the first and second members diverging from one another, and the first and second members each including a first side and a second side, an inner side and an outer side. The first and second members being directly or indirectly associated with one another. The hanging corner shelf assembly further including at least one shelf member extending from the first member and the second member, wherein a longitudinal axis of the at least one shelf member is generally perpendicularly oriented relative to a longitudinal axis of each of the first and second members. The hanging corner shelf assembly also includes at least one hanging member, wherein the at least one hanging member is engaged to the first and/or second member.

In another embodiment, there is provided a hanging corner shelf assembly including at least a first member and a second member, the first and second members each having a top side, a bottom side, an inner side, an outer side, a first side and a second side. The hanging corner shelf assembly further including a first and a second hanging member engaged to the first and second members, respectively, such that the hanging corner shelf assembly can be suspended in a corner between two abutting surfaces, wherein the first and second hanging members associate with a top portion of each abutting surface. The hanging corner shelf assembly further includes at least one shelf member extending from the first and second members, the shelf member comprising a top side, a bottom side, a medial surface, and a distal surface.

In still a further embodiment, a hanging corner shelf kit is provided. The hanging corner shelf kit includes a hanging corner shelf, including a first member and a second member. The first and second members each include a first side and a second side, an inner side and an outer side. The kit further provides an attachment mechanism for adjoining the first and second members. Alternatively, the first and second members are configured such that they may be adjoined without an attachment mechanism. Also, alternatively, the first and second members may be preadjoined such as through a hinge mechanism. The hanging corner shelf kit further includes at least one hanging member engageable to the first and/or second member, and at least one shelf member, the at least one shelf member including a medial surface and a distal surface, the at least one shelf member configured for attachment to the first and second members when the hanging corner shelf is in an assembled position.

According to another embodiment, a method of creating a shelf in an orthogonal corner formed by two walls is provided, wherein the at least one of said two walls has access from a top side thereof. The method includes hanging a hanging corner shelf assembly such as that described herein on the at least one of said two walls.

BRIEF DESCRIPTION OF THE DRAWINGS

Various objects, features, and attendant advantages of the present invention will be more fully appreciated s the same becomes better understood from the following detailed description of the present invention when considered in connection with the accompanying drawings, in which.

DETAILED DESCRIPTION

Figure 1:
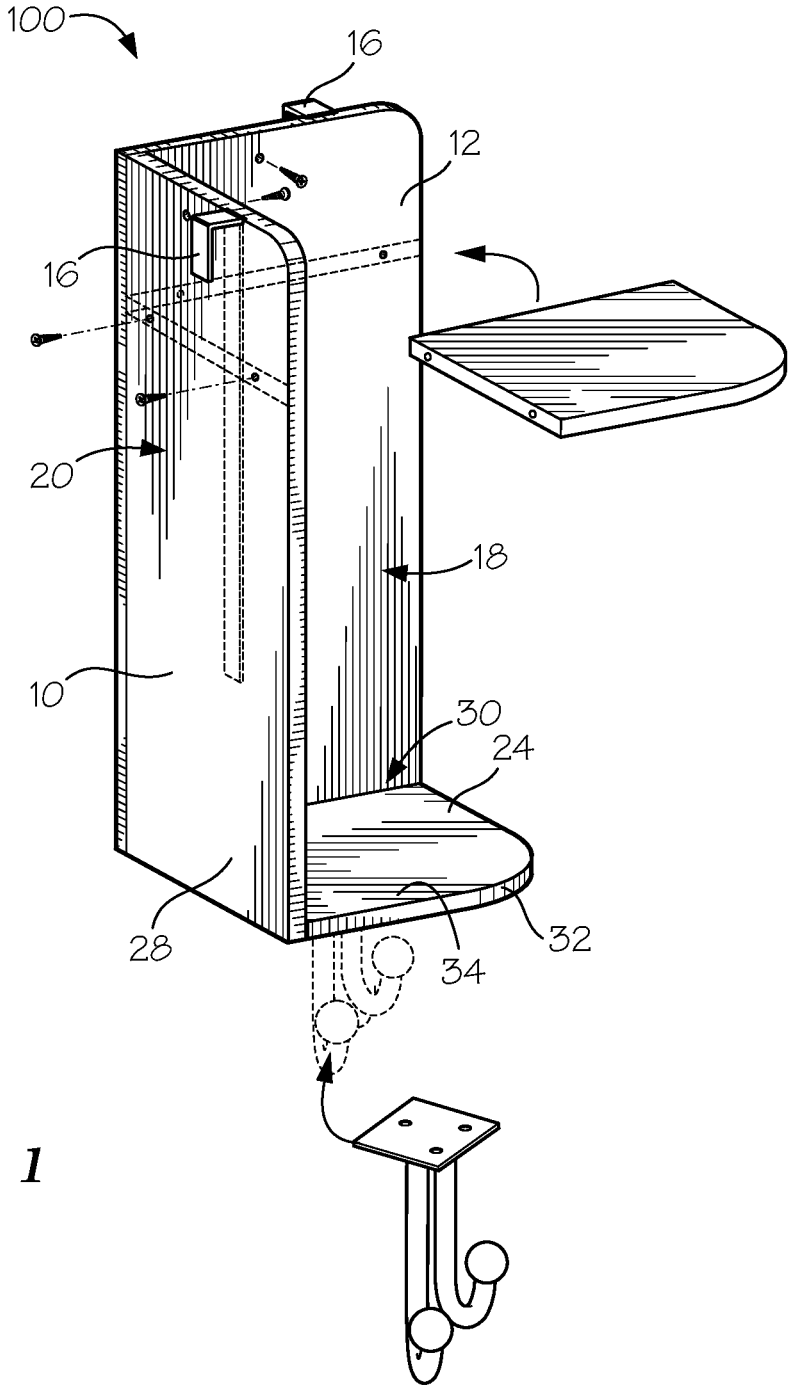
FIG. 1 is a top front perspective view of the hanging corner shelf assembly.

For the purposes of promoting an understanding of the principles and operation of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to those skilled in the art to which the invention pertains.

In an embodiment, a hanging corner shelf assembly is provided. The hanging corner shelf assembly includes a first member and a second member, the first and second members diverging from one another, and the first and second members each including a first side and a second side, an inner side and an outer side. The inner sides of each of the first and second members are directly or indirectly associated with one another. The hanging corner shelf assembly further including at least one shelf member disposed between the first member and the second member such that the shelf member extends from the first sides of each of the first and second members, wherein a longitudinal axis of the at least one shelf member is generally perpendicularly oriented relative to a longitudinal axis of each of the first and second members. The term generally perpendicular as used herein includes perpendicular or 0-20 degrees above or below a perpendicular plane. The hanging corner shelf assembly also includes at least one hanging member, wherein the at least one hanging member is engaged to the first and/or second member.

In a particular embodiment, the attachment mechanism comprises at least one hinge. The at least one hinge may be in the form of a mechanical hinge, in one embodiment, or may be formed during the manufacturing process out of the material of which the first and second members are made of, such as a hinge integrated into the first and second members. For example, the first and second members would be molded such that the joint between them would form a hinge in an embodiment. In this manner, the first and second members can pivot around a vertical axis via the hinge in order to adjust the degree of the angle between the two members so as to accommodate the shelf member there between.

In another alternative embodiment, the hanging corner shelf assembly is further provided wherein the first and second members each comprise a top side and a bottom side, and a lip or a tab protruding from each of the first and second members toward the lip of the other of first and second member; the lips or tabs are provided such that the at least one shelf member can be suspended between the first and second members.

In a further embodiment, the hanging corner shelf assembly is provided, including a second hanging member, wherein the first and the second hanging members are engaged to the first and second members, respectively. In an alternative embodiment, the first and second hanging members are engaged to one of the first or second members.

In a specific embodiment, there is provided a hanging corner shelf assembly including at least a first member and a second member, the first and second members each having a top side, a bottom side, an inner side, an outer side, a first side and a second side. The hanging corner shelf assembly further including a first and a second hanging member disposed on the second side of each of the first and second members, respectively, such that the hanging corner shelf assembly can be suspended in a corner between two abutting surfaces, wherein the first and second hanging members associate with a top portion of each abutting surface. The hanging corner shelf assembly further includes at least one shelf member extending from the first and second members. The shelf member includes a top side, a bottom side, a medial surface, and a distal surface.

In one particular embodiment, the at least one shelf member is attached to the first and second members via an adhesive. The at least one shelf member may be attached to the first and second members by any methods known in the art, including but not limited to a tongue and groove attachment as known in the art. The shelf member may, in another embodiment, be attached to the first and second members via a welded joint.

In another embodiment, the hanging corner shelf assembly is provided wherein the at least one shelf member extends from the first and second members, and is attached to the first and second members via a fastener. In one embodiment, the at least one shelf member and the first and second members may include pre-set apertures and a screw may be threaded through the apertures to provide a fixed attachment there between. Other types of fasteners known in the art may be used (e.g. but not limited to, screws, nails, tacks, rivets, staples, hook/loop fabric, or adhesives).

In a further embodiment, a utility attachment is provided associated with a hanging corner shelf assembly. The utility attachment may comprise a ring, hook, or bar that allows items such as a purse, cane, umbrella etc. to be held by the utility attachment. The utility attachment typically extends from a bottom shelf.

In still a further embodiment, a hanging corner shelf kit is provided. The hanging corner shelf kit includes a hanging corner shelf, including a first member and a second member. The first and second members each having a first side and a second side, an inner side and an outer side. The kit further provides an attachment mechanism for adjoining the first and second members, including but not limited to bracket, screws, nails, hinge and the like. Alternatively, the first and second members are configured such that they may be adjoined without an attachment mechanism. Such configuration may include but is not limited to, a tongue and groove configuration, a slide-in slot on at least one of the members, protrusion and receptacle mating arrangement, and the like. Also, alternatively, the first and second members may be preadjoined such as through a hinge mechanism. The hanging corner shelf kit further includes at least one hanging member engageable to the first and/or second member, and at least one shelf member, the at least one shelf member including a medial surface and a distal surface, the at least one shelf member configured for attachment to the first and second members when the hanging corner shelf is in an assembled position. The kit may further include a utility attachment that is engaged to the bottommost shelf.

The hanging corner shelf can be provided in dimensions which comply with the ADA requirements for wheelchair accessibility, in some embodiments, particularly for use in public bathroom stalls. According to the ADA wheelchair accessibility guidelines for buildings and facilities, the maximum high reach allowed for a person in a wheelchair is 48 inches (1220 mm) for forward reach cases. In the case that the floor space allows parallel approach by a person in a wheelchair, the maximum high side reach allowed is 54 inches (1370 mm). The subject invention may be embodied in a number of varying height, width, and length dimensions. In one particular embodiment, the hanging corner shelf is provided at a length of 24 inches. In other embodiments the length may range depending on the height of the abutting surfaces or walls of a bathroom stall upon which the hanging corner shelf will be provided. In another particular embodiment, the hanging corner shelf is provided approximately 40-46 inches from the floor. In one particular embodiment, the at least one shelf member is provided of such a dimension that it extends outward from the wall at approximately 12-13 inches at its widest point.

The at least one hanging member may be removably affixed to the second side, top side, first side, or bottom side, or combination thereof, of the first and/or second member via fasteners (e.g. but not limited to screws, nails, tacks, rivets, staples, hook/loop fabric, or adhesives). The hanging member typically will include at least a resting body portion (for holding the assembly on the top side of a wall) and a catch member portion (e.g. wing portion to keep the resting body portion from sliding off the top side of a wall). Further, secondary support fastener(s) may be utilized to further secure the hanging corner assembly to a wall upon which the assembly is hung (see, e.g., screws shown in FIG. 1). One skilled in the art will appreciate that the placement and number of fasteners (including adhesive) may vary depending on the desired or required amount of support. Also, the amount by which the at least one hanging member may extend along the first or second members can vary depending on the desired amount of support (as represented by dashed lines in FIGS. 1-7).

In another alternative embodiment, what is provided is a hanging corner assembly that includes an enclosure. According to this embodiment, the assembly includes a first member and a second member, the first and second members diverging from one another, and the first and second members each including a first side and a second side, an inner side and an outer side. The inner sides of each of the first and second members are directly or indirectly associated with one another. The hanging corner shelf assembly further including at least one shelf member disposed between the first member and the second member such that the shelf member extends from the first sides of each of the first and second members, wherein a longitudinal axis of the at least one shelf member is generally perpendicularly oriented relative to a longitudinal axis of each of the first and second members. The space defined by the first and second members, and the shelf, may be enclosed by at least one door member that is associated with the first and second members. Further, a top portion mirroring the shelf member may be included such that the door member encloses the space defined by the shelf member, first and second members, and top portion, when the door member is in a closed position.

The height of the hanging corner shelf may also be vertically adjusted via the at least one hanging member, which may be provided as an adjustable hanging member. Therefore, the hanging member may be vertically adjusted relative to the first and/or second member and fastened in the desired position. The design, shape and size of the at least one hanging member may vary and is not limited to that which is embodied in the Figures as shown herein. Additional hanging members may also be provided. The hanging members may be embodied as a hook, or a clamp, or any other similar hanging member as known in the art.

Turning to the Figures, FIG. 1 provides a top front perspective view of the hanging corner shelf assembly 100, wherein a first member 10 is associated with a second member 12 via an inner side 26 of each of the first and second members 10, 12. Each of the first and the second members 10, 12, includes a first side 18, a second side 20, and an outer side 28. The second side 20 of at least one of the first and second members 10, 12 includes at least one hanging member 16 disposed thereon. A shelf member 24 extends from the first member 10 and the second member 12. The shelf member 24 includes a medial surface 30 and a distal surface 32, wherein the medial surface 30 contacts the first sides 18 of each of the first and second members 10, 12, in this embodiment, such that an anterior portion 34 of the shelf member 24 can be seen in this Figure. A hanging member 16 is engaged to each of the first and second members 10, 12, in the embodiment shown in FIG. 1.

Figure 2:
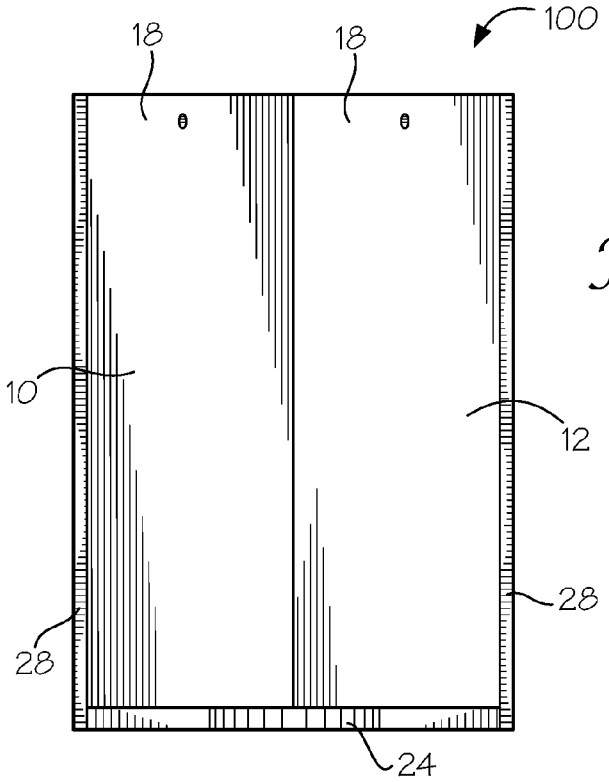
FIG. 2 provides a front elevational view of the hanging corner shelf assembly.
Figure 3:
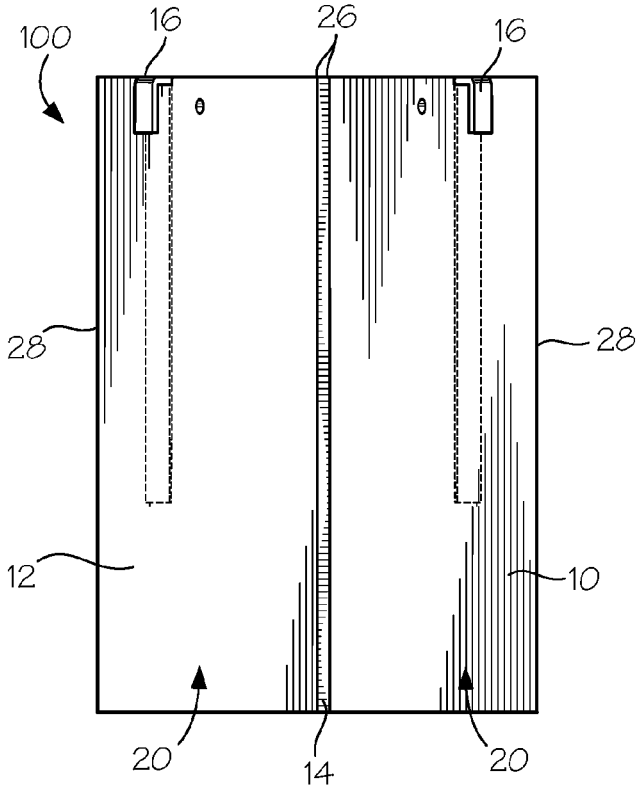
FIG. 3 is a back elevational view of the hanging corner shelf assembly.

FIG. 2 is a front elevational view of an embodiment of the hanging corner shelf assembly 100, wherein the first side 18 of each of the first and second members 10, 12 is shown. The distal surface 32 of the shelf member 24 is also visible in this view. FIG. 3 provides a back elevational view of the hanging corner shelf assembly, wherein the second side 20 of each of the first and second members 10, 12 is shown. The attachment means 14 between the first and second members 10, 12 in this particular embodiment is provided as a hinged joint, such that the first and second members 10, 12 can pivot toward and away from one another about the attachment means 14. The hanging members 16 can also be found engaged to each of the first and second members 10, 12 in FIG. 3.

Figure 4:
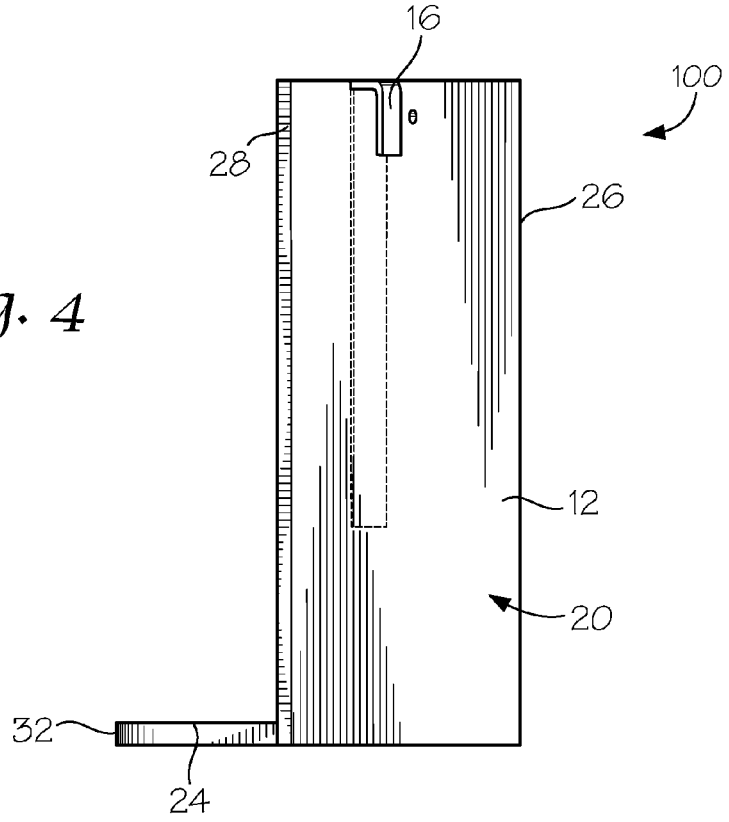
FIG. 4 is a left side elevational view of the hanging corner shelf assembly embodiment including a second hanging member disposed on the back side of the second member.

FIG. 4 is a left side elevational view of an embodiment of the hanging corner shelf assembly 100. The second side 20 of the second member 12 as well as a portion of the distal surface 32 of the shelf member 24 is visible in this Figure. One hanging member 16 is provided as engaged to the second member 12 in this embodiment.

Figure 5:
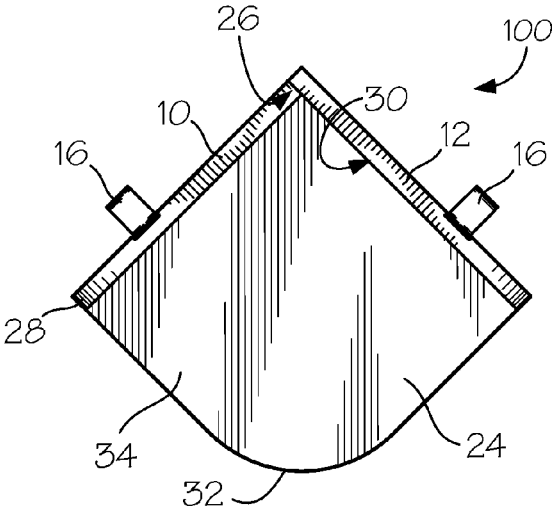
FIG. 5 provides a top plan view of the hanging corner shelf assembly.
Figure 6:
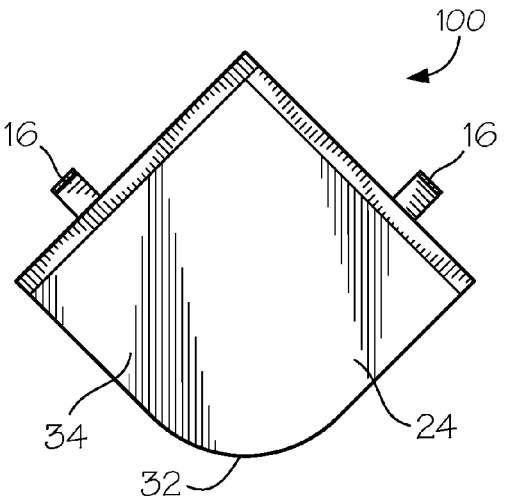
FIG. 6 provides a bottom plan view of the hanging corner shelf assembly.

FIG. 5 provides a top plan view of an embodiment of the hanging corner shelf assembly 100, wherein an anterior portion 34 of the shelf member 24 is visible, as well as the top portions of each of the first member 10, second member 12, and the hanging members 16 which are engaged to the first and second members 10, 12 in this embodiment. FIG. 6 provides a bottom plan view of the hanging corner assembly 100, wherein the hanging members 16, engaged to the first and second members 10, 12, are viewed from the bottom of the assembly in this embodiment. A posterior portion 36 of the shelf member 24 is visible in FIG. 6.

Figure 7:
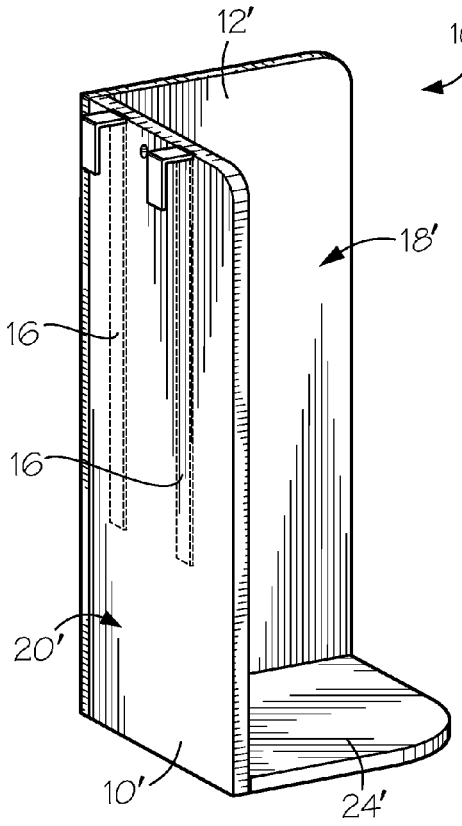
FIG. 7 provides a top perspective view of an alternative embodiment of the hanging corner shelf assembly.

FIG. 7 is a top perspective view of an alternate embodiment of the hanging corner shelf assembly 100', in which two hanging members 16 are engaged to the first member 10'.

Figure 8:
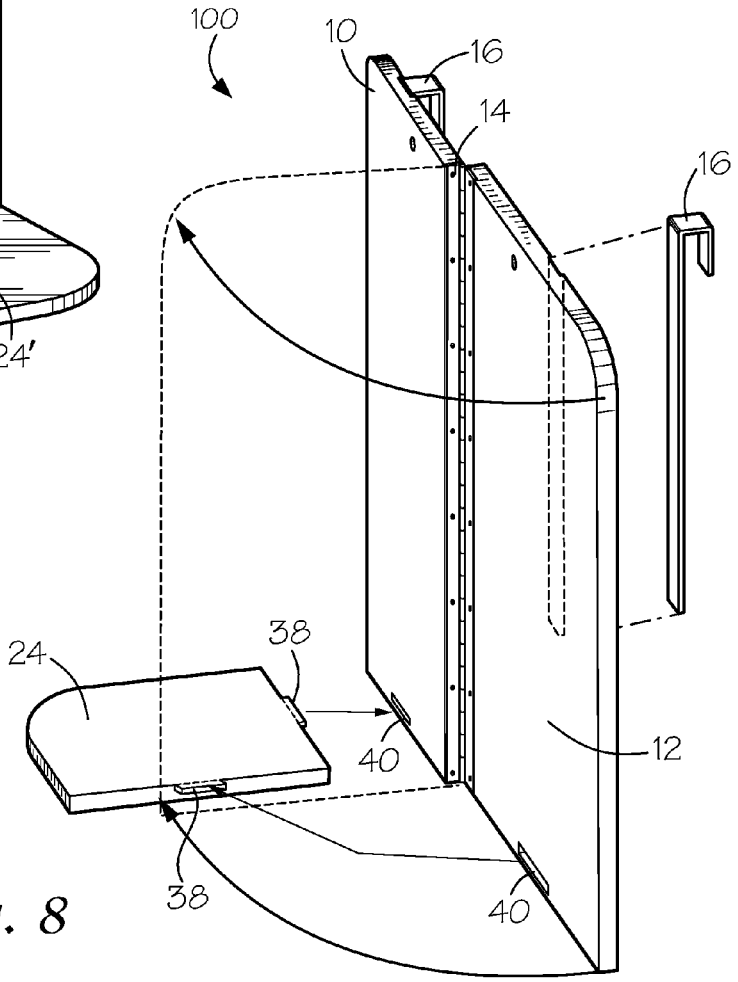
FIG. 8 provides an exploded assembly view of the hanging corner shelf assembly of FIG. 7.

FIG. 8 provides an exploded assembly view of the hanging corner shelf assembly 100 in an unassembled state. The first and second members 10, 12, are shown as separated by an attachment means 14 embodied as a hinge mechanism providing freedom of rotation of the first and second members about the hinge, wherein anywhere between a zero to approximately 180 degree distance between the first and second members 10, 12, can be achieved. The shelf member 24 is represented in this particular embodiment with protrusions 38, and the first and second members 10, 12, are provided with mating receptacles, 40, such that a protrusion and receptacle mating arrangement is provided. One of the hanging members 16 is shown in FIG. 8 as disengaged from the second member 12. Therefore, to assemble the hanging corner shelf assembly, the protrusions 38 are inserted into the receptacles 40 of the mating arrangement of FIG. 8, and the disengaged hanging member 16 is engaged with the second member 12 such that the shelf member 24 extends from the first and second members 10, 12 when the hanging corner shelf assembly is in an assembled position.

While a number of embodiments of the present invention have been shown and described herein in the present context, such embodiments are provided by way of example only, and not of limitation. Numerous variations, changes and substitutions will occur to those of skill in the art without materially departing from the invention herein. For example, the present invention need not be limited to best mode disclosed herein, since other applications can equally benefit from the teachings of the present invention. Also, in the claims, means-plus-function and step-plus-function clauses are intended to cover the structures and acts, respectively, described herein as performing the recited function and not only structural equivalents or act equivalents, but also equivalent structures or equivalent acts, respectively. Accordingly, all such modifications are intended to be included within the scope of this invention as defined in the following claims, in accordance with relevant law as to their interpretation.

What is claimed is:

1. A hanging corner shelf assembly for suspending in a corner between two abutting surfaces, comprising:

a first wall member and a second wall member, said first and second wall members diverging from one another at a generally perpendicular angle, said first and second wall members each comprising a first side, a second side, a top side, an inner side and an outer side, the first and second wall members being connected to each other by a hinge, the second side of each of the first and second wall members comprises a slot defined therein;

at least one shelf member extending from the first sides of each of the first and second members, wherein a longitudinal axis of the at least one shelf member is generally perpendicularly oriented relative to a longitudinal axis of each of the first and second members, wherein the at least one shelf member comprises a medial surface that abuts against the first side of each of the first and second members and is attached to the first and second members via an adhesive, a fastener, a tongue in groove arrangement or a welded joint; and at least a first hanging member, wherein said first hanging member is engaged to the first or second member, wherein said first hanging member is configured to associate with a top portion of one of the abutting surfaces to suspend the hanging corner shelf assembly from the corresponding abutting surface, wherein said at least one first hanging member comprises a resting body portion and a catch member portion configured in an L-shape, and an elongated portion extending along and nested within the slot of the first or second member to which the at least one first hanging member is engaged, wherein the resting body portion is adjacent to the top side of the first or second member to which the at least one first hanging member is engaged.

2. The hanging corner shelf assembly of claim 1, wherein the first and second wall members each comprise a top side and a bottom side, and a protrusion extending from either of the first and second wall members or the at least one shelf member, and a receptacle provided in the other of the first and second wall members or the at least one shelf member, such that a protrusion and receptacle mating arrangement is provided there between.

3. The hanging corner shelf assembly of claim 1, further comprising a second hanging member, wherein the first hanging member is engaged to the first wall member and the second hanging member is engaged to the second wall member.

4. The hanging corner assembly of claim 1, further comprising a utility attachment associated therewith.

5. The hanging corner assembly of claim 4, wherein said utility attachment is a hook.

6. The hanging corner assembly of claim 1, wherein said assembly is comprised of a material suitable for use in a bathroom stall or shower stall.

* * * * *